US012077926B2

(12) United States Patent
Kennedy

(10) Patent No.: US 12,077,926 B2
(45) Date of Patent: Sep. 3, 2024

(54) CURB SWEEPER APPARATUS FOR BLADE-CARRYING MACHINES

(71) Applicant: Richard Kennedy, Ocala, FL (US)

(72) Inventor: Richard Kennedy, Ocala, FL (US)

( * ) Notice: Subject to any disclaimer, the term of this patent is extended or adjusted under 35 U.S.C. 154(b) by 0 days.

(21) Appl. No.: 18/404,872

(22) Filed: Jan. 4, 2024

(65) Prior Publication Data

US 2024/0229389 A1 Jul. 11, 2024

Related U.S. Application Data

(60) Provisional application No. 63/437,342, filed on Jan. 5, 2023.

(51) Int. Cl.

| | |
|---|---|
| ***E01H 1/05*** | (2006.01) |
| ***A46B 9/02*** | (2006.01) |
| ***A46B 13/00*** | (2006.01) |
| ***A46B 13/02*** | (2006.01) |
| ***E02F 3/96*** | (2006.01) |

(52) U.S. Cl.

CPC ..... *E01H 1/056* (2013.01); *A46B 9/025* (2013.01); *A46B 9/026* (2013.01); *A46B 13/001* (2013.01); *A46B 13/02* (2013.01); *E02F 3/962* (2013.01); *A46B 2200/3066* (2013.01)

(58) Field of Classification Search

CPC ..... E01H 5/066; E01H 5/06; E01H 5/092; E01H 5/098; E01H 1/056; A46B 13/001; E02F 3/962

See application file for complete search history.

(56) References Cited

U.S. PATENT DOCUMENTS

| | | | |
|---|---|---|---|
| 2,101,769 | A | 12/1937 | Westmoreland |
| 3,113,332 | A | 12/1963 | Kasper |
| 4,414,699 | A | 11/1983 | Hirt |
| 4,620,341 | A | 11/1986 | Rigby |
| 5,107,932 | A | 4/1992 | Zachman et al. |
| 5,182,830 | A | 2/1993 | Viola |
| 6,088,865 | A | 6/2000 | Truan et al. |
| 6,944,980 | B1 | 9/2005 | Lefrancois |
| 7,100,314 | B1 | 9/2006 | Jensen |
| 7,793,740 | B2 | 9/2010 | Thomson et al. |
| 7,861,347 | B2 | 1/2011 | McKeown et al. |
| 9,237,690 | B2 | 1/2016 | Pavan |
| 9,551,455 | B2 | 1/2017 | Collings |
| 10,711,416 | B2 | 7/2020 | Glubrecht et al. |
| 2010/0163259 | A1 | 7/2010 | Howson et al. |

FOREIGN PATENT DOCUMENTS

| | | | |
|---|---|---|---|
| CA | 3 015 581 | | 2/2020 |
| CN | 215441713 U | * | 1/2022 |
| CN | 217460435 U | * | 9/2022 |
| KR | 20120032304 A | * | 4/2012 |
| KR | 20160114957 A | * | 6/2016 |

* cited by examiner

*Primary Examiner* — Shay Karls

(74) *Attorney, Agent, or Firm* — Douglas Wm. Massinger

(57) ABSTRACT

A curb sweeping apparatus for releasable engagement with a blade of a blade-carrying machine such as a motor grader, for example, the blade being arcuate in cross-section and having a top edge and a bottom cutting edge, the sweeping apparatus being comprised of a height and depth adjustable mounting assembly, a carrier frame fixedly connected to the mounting assembly, and a motor-driven rotary sweeper comprised of a sweeper brush assembly rotatably mounted to the carrier frame and a sweeper motor mounted to the carrier frame and operably coupled to the sweeper brush assembly.

20 Claims, 8 Drawing Sheets

CURB SWEEPER APPARATUS FOR BLADE-CARRYING MACHINES

CROSS-REFERENCE TO RELATED APPLICATIONS

This application claims the benefit of U.S. Provisional Application No. 63/437,342 filed Jan. 5, 2023 and entitled, Curb Sweeper Apparatus for Motor Graders.

FIELD OF THE INVENTION

The subject invention relates to a curb-sweeping apparatus mountable to, and operable from, the blade of a blade-carrying machine such as a motor grader, for example.

BACKGROUND OF THE INVENTION

In civil engineering "rough grading" is performed by heavy equipment such as wheel tractor-scrapers and bulldozers whereas "finish grading" is performed by motor graders. A motor grader, also commonly referred to as a grader, road grader, or simply a blade, is a form of heavy equipment with a long blade (also known as a "moldboard") used to create a flat surface during grading.

Motor graders typically include an elongated frame assembly with at least two sets of wheels that are widely spaced from one another, and a blade assembly disposed between the sets of wheels. Variations in motor grader designs include, for example, machines having two closely disposed pairs of rear wheels from which a front pair of wheels is spaced, and machines that have articulated front and rear frame assemblies.

One of the features that makes motor graders especially fit for finish grading is that the angle (relative to a vertical axis of rotation), slope (relative to horizontal), tilt (or pitch) and height of their blade (relative to ground) are all capable of being adjusted to a high level of precision. In constructing paved roads, motor graders prepare a wide flat base course for the final road surface. When curbing exists, the motor grader can set the depth of the base course to the desired level below the curb so that the final finish grade is at the desired depth below the curb gutter. Another design feature that makes motor graders ideal for this purpose is that the operator cab is positioned between the motor housing and the blade. Such an arrangement assures that the motor housing does not obstruct the operator's view of the blade. Accordingly, a skilled motor grader operator can cause the ends of the blade to be in very close proximity to the curb toe in order to remove adjacent material, and cause that removed material to flow away from the curb and gutter during the grading process. Regardless of the skill level of the operator, however, it is inevitable that some ground material will end up on the curb, or more specifically, in the gutter. This material must be removed prior to application of the surface course.

Various types of machines have been developed to sweep or vacuum debris from pavements, roadways, streets and gutters. In general, these machines can be classified as mechanical broom sweepers, regenerative air sweepers, vacuum sweepers, and, in some cases, combinational variants thereof. A substantial number of such machines are in the form of a vehicle specially designed for the sole task of debris removal. As such, they require a substantial investment of capital to acquire and are commonly comprised of a complex array of working parts which increases the risk of mechanical failure due to wear, mishandling or accidents.

Smaller and less complex options do exist in the form of walk-behind self-propelled machines, but these too can be relatively expensive. Still further, there exist a number of sweeping apparatuses intended to be mounted to the frame of a motor vehicle, typically a truck. Such variety of sweepers suffer from various shortcomings. For example, they require large and bulky frames that must be mounted to the vehicle's chassis and supported in cantilevered fashion, they are cumbersome to move when not in use and not suitable for transport in the back of a pickup truck, and they often are comprised of a necessarily large number of components including, by way of example only, angle cylinders, an A-frame (aka push frame) for attachment to the vehicle's coupler, a hydraulic attachment system, a base angle, a blade lift, blade shocks, a control box for truck-side electrical components, a controller (joystick or hand held), a coupler that houses the hydraulic manifold and power unit, hydraulics to lift, lower and angle the sweeper, etc. As a result of the aforesaid shortcomings and limitations of prior art sweeping devices, it is common in the road construction industry to hire two or more employees or contractors to manually remove the debris from gutters and curbs using brooms and shovels. Anyone involved in operating a motor grader as a full-time career knows all too well how the expense of such workers impacts the business' bottom line. This can be particularly frustrating when such laborers sit idle during work delays but must be paid nonetheless for their time.

Accordingly, there is a need in the road grading industry for a sweeping apparatus that is relatively small in size, comprised of few moving parts, that requires little effort to move, mount and dismount from a carrier vehicle, needs little maintenance, and that does not require a substantial investment of capital to acquire.

SUMMARY OF THE INVENTION

The subject invention meets the above-described needs in the art by providing a curb-sweeping apparatus that is mountable to, and leverages the strength, visibility and multi-directional movement capabilities of, an adjustable blade of a motor-driven blade carrying machine such as a motor grader. More specifically, embodiments of the sweeping apparatus of the subject invention are intended for mounting on either end of a "blade-carrying machine" as defined and described in detail herein. In accordance with one aspect of the present invention there is provided, generally, a sweeping apparatus for releasable engagement with a blade of a blade-carrying machine, the blade being arcuate in cross-section and having a top edge, a bottom edge (which is typically a cutting edge), a left end portion, a right end portion, and a front face, the sweeping apparatus comprising: a height and depth adjustable mounting assembly, a carrier frame fixedly connected to the mounting assembly, and a motor-driven rotary sweeper comprised of a sweeper brush assembly rotatably mounted to the carrier frame and a sweeper motor mounted to the carrier frame and operably coupled to the sweeper brush assembly.

In certain embodiments of the invention there is provided, more particularly, a sweeping apparatus for releasable engagement with a blade of a blade-carrying machine, the blade being arcuate in cross-section and having a top edge, a bottom edge, a left end portion, a right end portion, and a front face, the sweeping apparatus comprising a height and depth adjustable mounting assembly, a carrier frame fixedly connected to the mounting assembly, a sweeper brush assembly mounted to the carrier frame, the sweeper brush assembly including one of a sweeper shaft or drum rotatable about a longitudinal axis substantially parallel with the ground, and a cylindrical brush head comprising a brush hub mounted to the sweeper shaft or said drum for rotation therewith, the brush hub having a plurality of bristles, and a sweeper motor mounted to the carrier frame and having a crankshaft coupled to the sweeper shaft to cause rotation of the sweeper shaft when the motor is energized; whereby mounting of the sweeping apparatus across the front face of selectively either the left end portion or right end portion of the blade is accomplished by tilting the top edge of the blade forward, driving the blade-carrying machine forward until the top edge of the blade is inserted into the mounting assembly, tilting the top edge of the blade rearward and simultaneously lifting the blade vertically until the bottom of the mounting assembly comes into abutting contact with the bottom edge of the blade.

In certain embodiments, the mounting assembly is comprised of a first vertical support and a second vertical support connected to one another by at least one cross brace, each of the first vertical support and second vertical support having a top portion; a first vertical extension member slidably and adjustably mounted to the top portion of the first vertical support, a second vertical extension member slidably and adjustably mounted to the top portion of the second vertical support, the first vertical extension member including a first forward canted arm, the second vertical extension member including a second forward canted arm, the first forward canted arm terminating in a first rearward canted arm extending perpendicular to the first forward canted arm, the second forward canted arm terminating in a second rearward canted arm extending perpendicular to the second forward canted arm; and a first L-shaped extension bracket slidably and adjustably mounted to the first rearward canted arm to form a first U-shaped channel into which the top edge of the blade is inserted when mounting the sweeping apparatus to the blade, and a second L-shaped extension bracket slidably and adjustably mounted to the second rearward canted arm to form a second U-shaped channel into which the top edge of the blade is inserted when mounting the sweeping apparatus to the blade; whereby, the depth of each U-shaped channel is adjustable to accommodate blades of varying thickness by sliding the first and said second extension brackets proximally or distally relative to the rearward canted arms from which they depend.

In other embodiments, at least one C-shaped hook may be bolted or welded to the top edge of the blade to work cooperatively with the mounting assembly to prevent detachment of the sweeper apparatus from the blade during operation of the motor grader, with detachment only being possible when the operator causes the top edge of the blade to tilt forward a sufficient degree to cause the hook to release the mounting assembly. As further described herein, use of two hooks prevents axial movement of the sweeper apparatus along the top edge of the blade. As should be readily appreciated, once the sweeper apparatus is mounted to one side of the blade and the motor activated, the bristles of the rotating drum brush will remove any ground material or other debris from the curb gutter as the blade-carrying machine travels along its length, with its operator selectively adjusting the degree of contact of the drum brush bristles with the curb surface by precisely adjusting the height of the blade relative to the surface to be cleaned.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a curb sweeper apparatus for removable attachment to, and operable from, the blade of a blade-carrying machine such as a motor grader.

It is also a primary object of the subject invention to provide a curb sweeper apparatus that can be mounted to a blade without manually lifting the curb sweeper apparatus.

It is another primary object of the subject invention to provide such a sweeper apparatus that can be mounted to a blade solely by manipulation of the blade.

Another object of the subject invention is to provide a curb-sweeper apparatus for blade-carrying machines such as motor graders that is relatively small in profile and therefore easily transported to the work site on a trailer or in the back of a pickup truck.

Another object of the subject invention is to provide a curb-sweeper apparatus for blade-carrying machines such as motor graders that is relatively simple in design, has few moving parts and is therefore easy to maintain and repair.

Still another object of the subject invention is to provide a curb-sweeper apparatus for blade-carrying machines such as motor graders that is susceptible of a low cost of manufacture with regard to both materials and labor, and which accordingly is then susceptible of low prices of sale to the consuming public.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
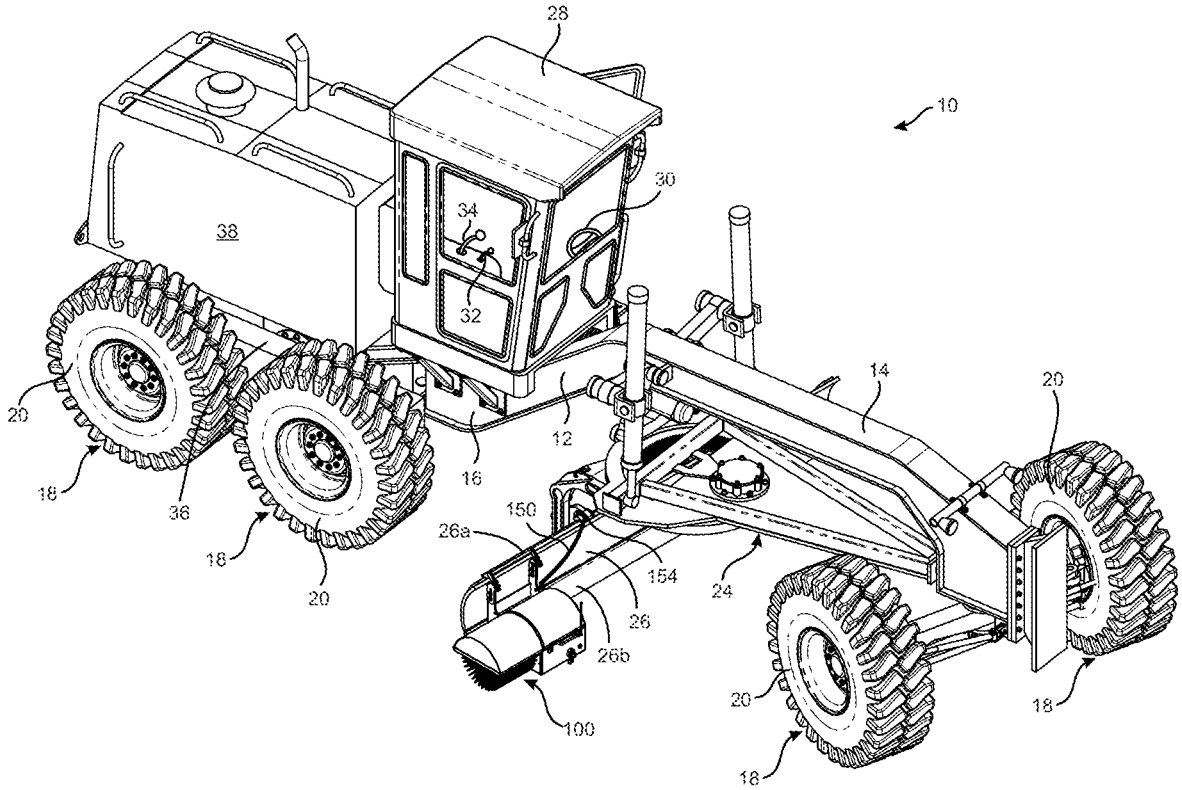
FIG. 1 is a right front quarter perspective view of typical motor grader having a blade to which a sweeping apparatus of the subject invention is mounted.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. The figures provided herewith are for explanation purposes to persons ordinarily skilled in the art and that the drawings are not necessarily drawn to scale. One of ordinary skill in the art will also appreciate that a component may be designed as multiple components or that multiple components may be designed as a single component.

Furthermore, reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "in some embodiments", "one example" or "an example" in various places throughout this specification are not necessarily all referring to the same embodiment or example. Furthermore, the particular features, structures or characteristics may be combined in any suitable combinations and/or sub-combinations in one or more embodiments or examples.

Before describing the various embodiments of the subject sweeping apparatus it is helpful to first describe, very basically, some primary components of a typical motor grader including the blade component to which the subject apparatus is intended to be mounted. Accordingly, reference is first made to FIG. 1 in which there is illustrated a typical motor grader 100 (hereinafter also referred to as "grader 10") portions of which have been eliminated or simplified when not important to an understanding of the invention having a sweeper apparatus of the subject invention, designated generally by reference numeral 100, mounted thereon as herein described. The motor grader 100 includes a mainframe 12 comprising a front frame portion 14 and a rear frame portion 16. The front and rear frame portions 14,16 may optionally be articulated at an articulated joint (not shown). Mainframe 12 is supported on a plurality of ground engaging members 18. In the illustrated embodiment, the ground engaging members 18 are comprised of a pair of front wheels 20 supported, directly or indirectly, by front frame portion 14, the front wheels being spaced from two pairs of rear wheels 22, which are disposed along opposite sides of the rear frame portion 16 from which they are supported. It will be appreciated, however, that the ground engaging members 18 may include alternate arrangements, such as, for example, a pair of front wheels 20 and a single pair of rear wheels, or the rear wheels 22 may alternately be track assemblies, as are known in the art.

A blade mounting and control assembly 24 (also referred to herein more simply as "blade control assembly 24") is mounted along the front frame section 14 for supporting and controlling a blade 26 (also known as a moldboard) which is utilized for grading. An example blade mounting and control assembly is described in U.S. patent Application Publication No. US2010/0163259A1 of Howson et al. published on Jul. 1, 2010 incorporated herein by reference for the sake of brevity. Regardless of the specific component parts used, or the details of their arrangement, blade control assembly 24 facilitates the adjustment of the angle (relative to a vertical axis of rotation), slope (relative to horizontal), tilt (or pitch) and height of blade 26 (relative to the motor grader 10) with a high level of precision.

With continued reference to FIG. 1, blade 26 has a curved profile, a top edge 26*a*, and a bottom cutting edge 26*b*. The bottom cutting portion of the blade is typically a separate component that can be replaced with wear. The length of the moldboard typically ranges from 6 to 24 feet, 12-16 feet being more common, with a thickness approximating 1 inch not including structural support bracing. Example motor grader blades have an arc radius ranging from approximately 16 to 24 inches. A 6-foot motor grader blade weighs approximately 200 pounds.

An operator cab 28 may be supported along mainframe 12 rearward of blade mounting and control assembly 24 generally, and blade 26 in particular such that the operator can maintain a clear view of blade 26. This high degree of visibility of blade 26, and the ability to manipulate it in multiple directions, makes it an ideal attachment point for the sweeper apparatus of the subject invention. Cab 28 may include, for example, a seat (not shown), a steering mechanism 30, a speed-throttle or control lever 32, and a joystick 34 which is a component of the blade mounting and control assembly 24 and used to control the movement of blade 26. An operator occupying the cab 28 can control the various functions and motion of the motor grader 10, for example, by using the steering mechanism 30 to set a direction of travel for the motor grader 10 and by using the control lever 32 to set the travel speed of the machine. As can be appreciated, the representations of the various control mechanisms presented herein are generic and are meant to encompass all possible mechanisms or devices used to convey an operator's commands to motor grader 10 and its blade control assembly 24.

The rear frame portion 16 of mainframe 12 includes a rear frame section 36 that is supported on the plurality of ground engaging members 18 along either side of grader 10. Rear frame section 36 supports engine compartment 38 and the engine and related components (not shown) for driving grader 10 forward and backward.

Figure 2:
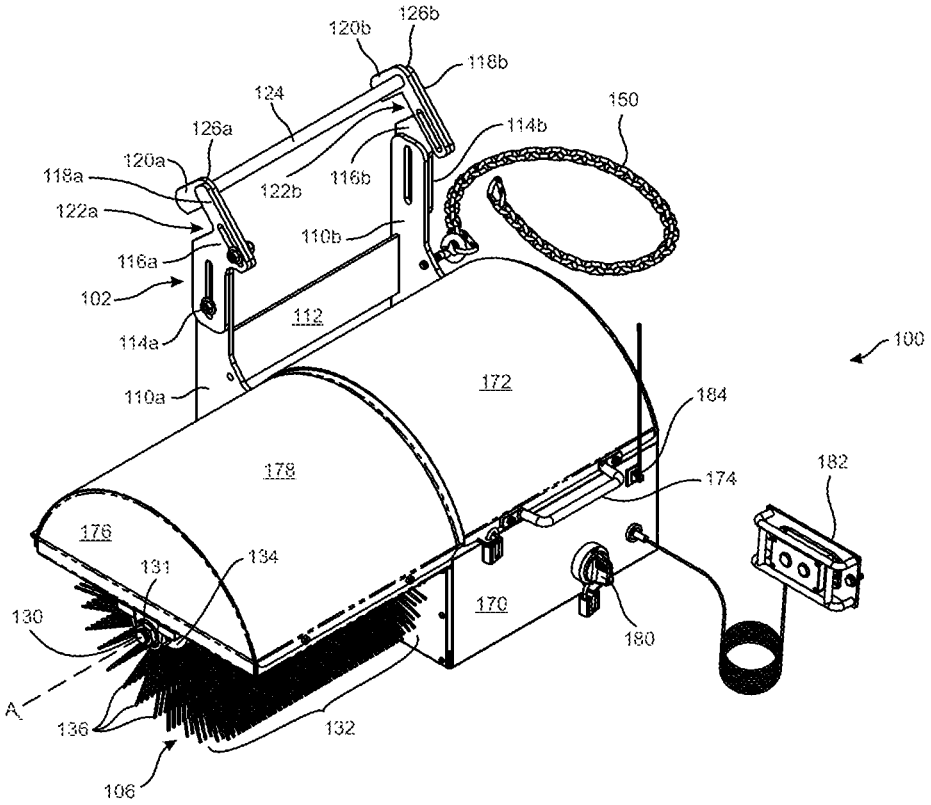
FIG. 2 is a right front quarter perspective view of an embodiment of the subject sweeper apparatus.
Figure 3:
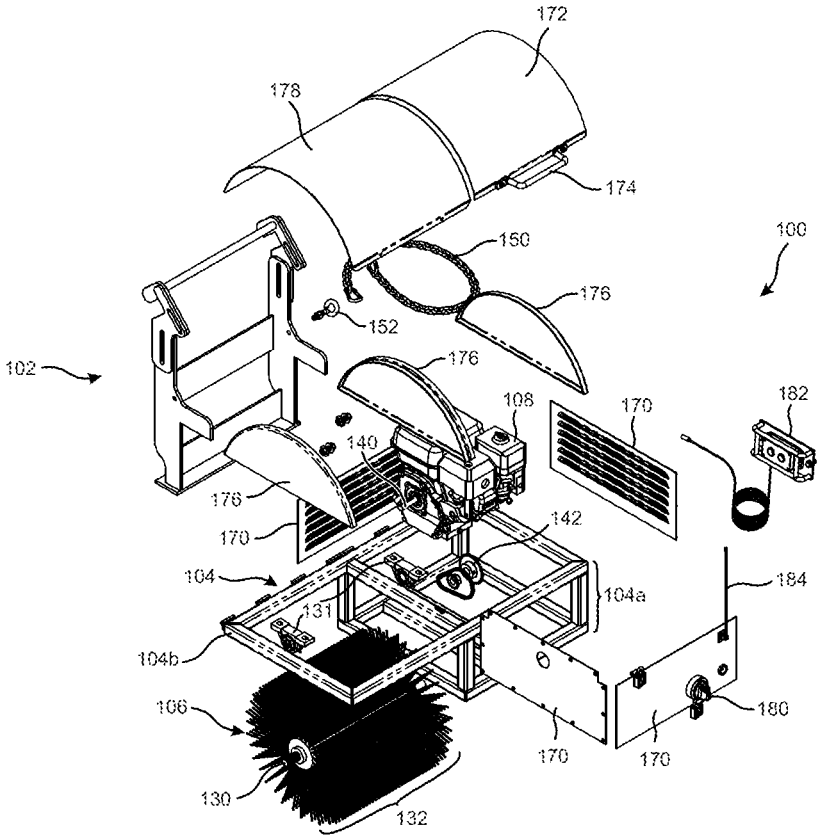
FIG. 3 is a right front quarter perspective view of the sweeper apparatus of FIG. 2 shown in exploded view to more easily distinguish its components.

Reference now being made to FIGS. 2 and 3, this disclosure relates to a curb-sweeper (aka "curb-sweeping") apparatus 100 for releasable engagement with a blade of a blade-carrying machine 10 illustrated in FIG. 1. While the sweeper apparatus 100 is illustrated in connection with a blade-carrying machine in the form of a motor grader, it could also be mounted to blades used on other blade-carrying machines provided the following minimum criteria are met: the blade-carrying machine must be power-driven; the blade-carrying machine must include a blade control assembly; the blade control assembly must be capable of orienting the blade with its cutting edge perpendicular or substantially perpendicular to the direction of travel of the blade-carrying machine; the blade of the blade-carrying machine must have a curved profile and have a top edge and a bottom edge; the blade of the blade-carrying machine must be capable of supporting the weight of the subject sweeper apparatus when mounted in close proximity to an end of the blade; the blade of the blade-carrying machine must be capable of a forward tilt and lift to accomplish mounting of the subject apparatus; and, ideally, but not essentially, the end of the blade to which the apparatus is mounted should be viewable by the operator of the blade-carrying machine. The term "blade-carrying machine" therefore refers to any motor-driven blade-carrying machine that has the above characteristics and capabilities. Some earth-moving machines, such as a tractor, wheel loader, excavator, dump truck, backhoe or the like may qualify.

Embodiments of a sweeper apparatus 100 for removable mounting to the blade of a blade-carrying machine are comprised of the following primary components: a height and depth adjustable mounting assembly 102, a carrier frame 104 fixedly connected to the mounting assembly, and a motor-driven rotary sweeper comprised of a sweeper brush assembly 106 rotatably mounted to the carrier frame and a sweeper motor 108 mounted to the carrier frame and operably coupled to the sweeper brush assembly.

In certain embodiments, mounting assembly 102 is comprised of a pair of vertical supports 110*a*, 110*b* (also referred to as "first vertical support 110*a*" and "second vertical support 110*b*") connected to one another by cross braces 112. A pair of vertical extension members 114*a*, 114*b* (also referred to as "first vertical extension member 114*a*" and "second vertical extension member 114*b*") are slidably and adjustably mounted to the top portions of corresponding vertical supports 110*a,b*, respectively, to enable vertical adjustment of the height of the mounting assembly 102 to accommodate mounting to blades of varying heights. Each vertical extension member 114*a,b* includes a forward canted arm 116*a,b*, respectively, (also referred to as "first forward canted arm 116*a*" and "second forward canted arm 116*b*") which are canted approximately 45 degrees to vertical, each of which in turn terminates in a rearward canted arms 118*a,b*, respectively, (also referred to as "first rearward canted arm 118*a*" and "second rearward canted arm 118*b*"). First rearward canted arm 118*a* extends perpendicular to first forward canted arm 116*a*, and second rearward canted arm 118*b* extends perpendicular to second forward canted arm 116*b*. A pair of L-shaped extension brackets 120*a*, 120*b* (also referred to as "first L-shaped extension bracket 120" and "second L-shaped extension bracket 120*b*") are slidably and adjustably mounted to rearward canted arms 118*a,b*, respectively, to form a pair of U-shaped channels 122*a*, 122*b* (also referred to as "first U-shaped channel 122*a*" and "second U-shaped channel 122*b*") into which the top edge 26*a* of blade 26 is inserted when mounting sweeper apparatus 100 to the blade. As may be appreciated, the depth of each channel 122*a,b* can be adjusted to accommodate blades of varying thickness (specifically along their top edge 26*a*) by sliding extension brackets 120*a*, 120*b* proximally or distally relative to the rearwardly canted arms 118*a,b* from which they depend. An "over the blade" crossbar 124 extends between the elbows 126*a*, 126*b* (also referred to as "first elbow 126*a*" and "second elbow 126*b*") of each extension bracket 120*a,b* for added stability and, in some embodiments, to serve as a mount for mounting hooks attached to blade 26 as described infra (see FIGS. 9-11). It is important to note that each channel 122*a,b* is oriented approximately 45 degrees to normal with its opening below elbows 126*a,b*, respectively. Accordingly, top edge 126*a* of blade 126 must be inserted upwards into channels 122*a,b*. In order for sweeper apparatus 100 to become dislodged from the blade a substantial amount of upward lifting force would be required. Such forces would not be ordinarily encountered during normal use of the apparatus.

Figure 6:
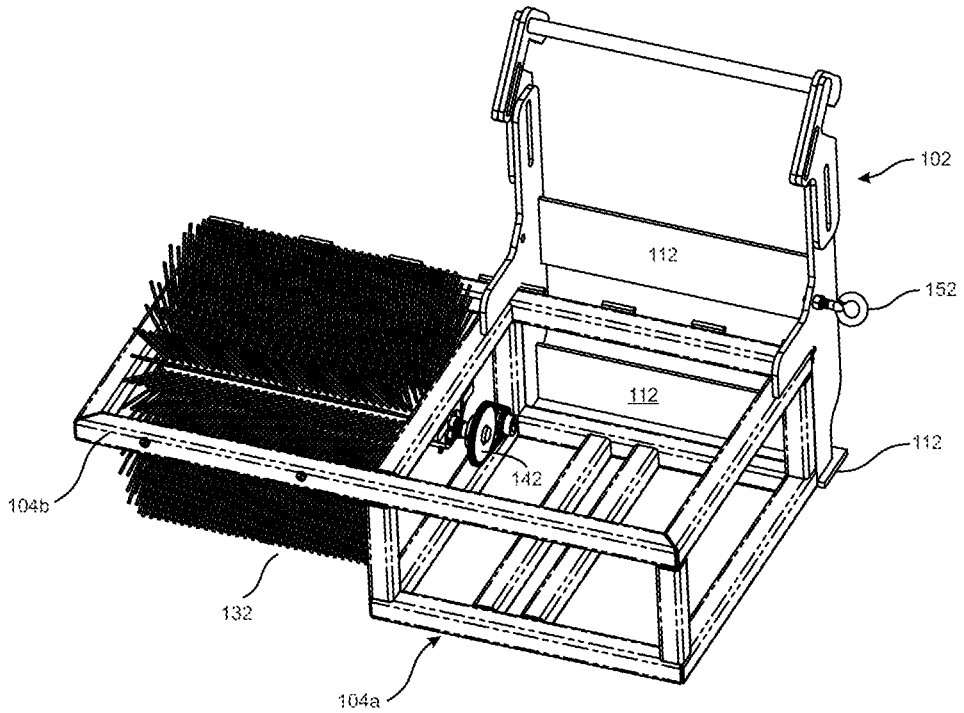
FIG. 6 is a left front quarter perspective view of the sweeper apparatus of FIG. 2 with top covers, housing and motor removed to better observe the sweeper brush assembly and chain drive assembly components.

Mounting assembly 102 is fixedly attached to carrier frame 104 preferably but not essentially via welding. As best observed upon reference to FIG. 6, in some embodiments, carrier frame 104 is constructed of a plurality of hollowed framing members, square in cross-section, and made of steel, metal alloys, or preferably aluminum. Carrier frame 104 includes a main carrier box portion 104*a* for supporting, inter alia, sweeper motor 108 and a supplemental carrier shelf portion 104*b* for supporting sweeper brush assembly 106. Carrier shelf portion 104*b* depends from carrier box portion 104*a* in cantilevered fashion. Together, carrier box portion 104*a* and carrier shelf portion 104*b* form a substantially rectangular shape when viewed in plan view. Those skilled in the art will appreciate, however, that a variety of framing configurations suitable for supporting the motor and brush components of the subject sweeper apparatus 100 may be employed.

Sweeper brush assembly 106 includes a sweeper shaft 130 in the form of a solid bar or hollowed drum (in the latter case, "drum 130") rotatable about a longitudinal axis $A_L$ substantially parallel with the ground. A cylindrical brush head 132 (also referred to as a "drum brush 132") comprises a brush hub 134 mounted to the sweeper shaft 130 for rotation therewith, the brush hub 134 having a plurality of bristles 136. In certain embodiments, the plurality of bristles 136 are comprised of a near continuous array of bristles 136 (typically in the form of pre-assembled bristle modules) mounted about the circumference of brush hub 134 and along its length and projecting away from its longitudinal axis $A_L$. Each end of sweeper shaft 130 is rotatably mounted within bearing mounts 131 which in turn are mounted to carrier frame 104. Bristles 136 can be made of natural or synthetic materials displaying one or more of the suitable characteristics such as durability, lightness or resiliency. For example, polymers, straw, fur, or the like may be used. In some embodiments the bristles 136 project from brush hub 134 in a substantially radial manner; in others bristles will project in a non-radial manner at some tangent to brush hub 134; in still further embodiments some bristles 136 may project radially while others project non-radially. In some embodiments, bristles 136 may be clustered in defined circumferential groups along the length of brush hub 134; in other embodiments they may be randomly dispersed along the length or arranged in a helical pattern as is known in the art. It is contemplated that brush head 132 may be removably attached to sweeper shaft 130 to permit replacement of the former when worn beyond practical use.

Figure 4:
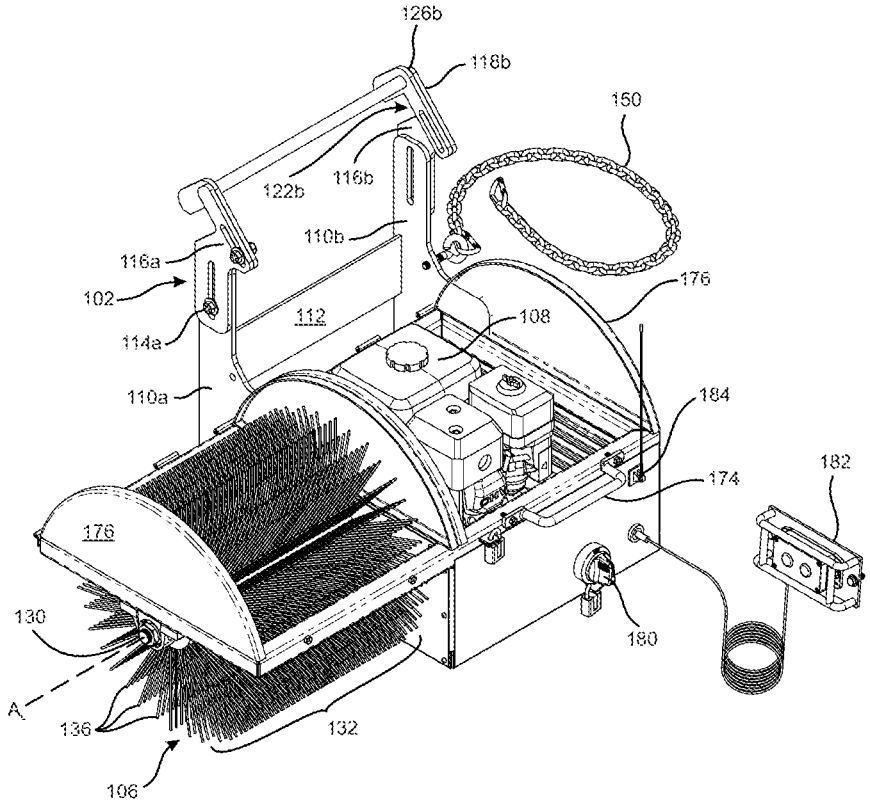
FIG. 4 is a right front quarter perspective view of the sweeper apparatus of FIG. 2 with top covers removed to better observe the arrangement of components thereunder.
Figure 5:
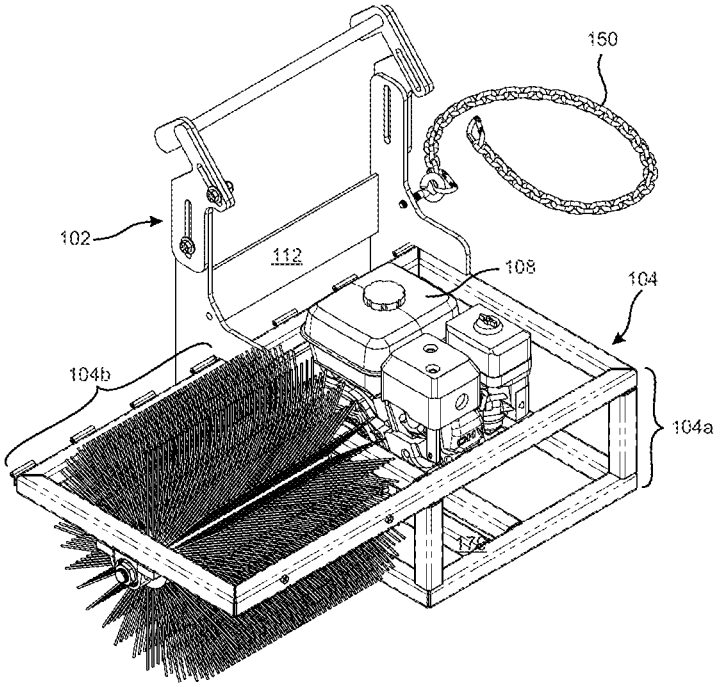
FIG. 5 is a right front quarter perspective view of the sweeper apparatus of FIG. 2 with top covers and housing removed to better observe the sweeper brush assembly and motor components mounted to the carrier frame.

As best observed upon reference to FIG. 4, sweeper motor 108 is mounted on the carrier frame 104 generally, and in carrier box portion 104*a* thereof in particular. In the embodiment illustrated, sweeper motor 108 is of the gasoline powered combustion engine variety, similar in construction to that of a typical lawnmower engine, but with a horizontal crankshaft 140 instead of vertical. It should be appreciated that alternate power means may be employed to drive sweeper shaft 130, and thus drum brush 132, including electric motors (having a "rotor" vs a crankshaft) or pneumatic or hydraulic motors, for instance. In any case, the crankshaft 140 (or corresponding rotary component) is coupled to the sweeper shaft 130 via any suitable coupling means including sleeve couplers, muff couplers, serrated (splined) couplers, split muff couplers, disc couplers, flange couplers or gear couplers. Some motors may advantageously be capable of changing the direction of the rotation of their shaft in either a clockwise or alternately counter-clockwise direction. Variable speed motors are preferred. In instances where the speed of the rotating shaft is too fast for effective use of the subject sweeping apparatus 100 and the speed cannot be adjusted downward, a motor/brush chain drive assembly 142 with gear reduction (FIGS. 3 and 6) may be operably interposed between sweeper shaft 130 and motor crankshaft 140.

Figure 7:
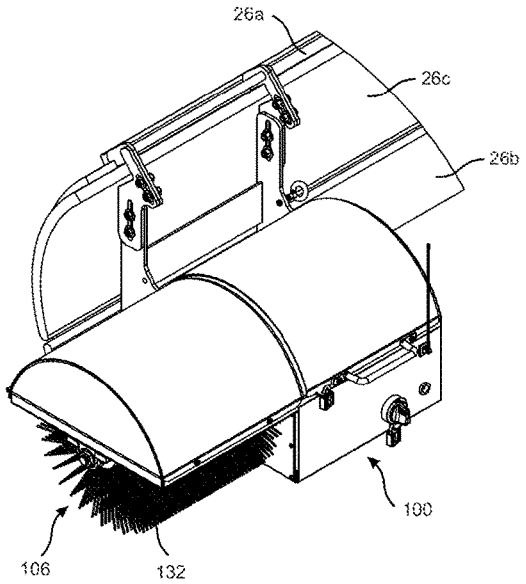
FIG. 7 is a right front quarter perspective view of first embodiment of the mounting assembly of the subject sweeper apparatus mounted to a blade.
Figure 8:
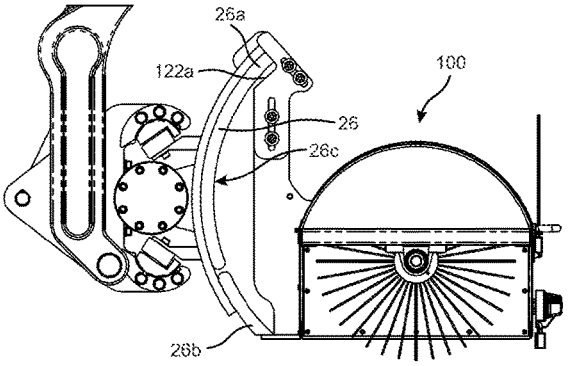
FIG. 8 is right side elevation view of the sweeper apparatus of FIG. 7.

With reference now being made to FIGS. 7 and 8, mounting of the sweeper apparatus 100 onto either the right (shown) or left (not shown) end of a blade 26 will be described. For practical purposes, sweeper apparatus 100 is intended to be mounted across the front face 26*c* of blade 26. To accomplish mounting or dismounting, no manual lifting of the sweeper apparatus is required. Instead, the blade-carrying machine 10 and its maneuverable blade 26 do all the work. To accomplish mounting, the operator causes blade 26 to be positioned immediately behind the mounting assembly 102 of the sweeper apparatus 100. Next, the top edge 26*a* of blade 26 is tilted forward in approximate alignment with channels 122*a,b,* motor grader 10 is then slowly idled forward until top edge 26*a* is inserted into the channels. Blade 26 is then tilted back to normal (vertical) position while simultaneously lifting the blade vertically until the bottom of mounting assembly 102 comes into abutting contact with the cutting edge 26*b* of the blade. As should readily be understood, top edge 26*a* acts as a pivot point upon which sweeper apparatus 100 is suspended via channels 122*a,b* and the weight of the cantilevered sweeper apparatus has a horizontal force component in the direction of blade 26 that causes the bottom of the sweeper apparatus to maintain contact with the blade absent any unusual jarring movements. In order to prevent sweeper apparatus 100 from sliding off the end of top edge 26*a* (which would be highly unlikely during normal operation) a tether 150 may be connected at one end to sweeping apparatus 100 via I-bolt 152 (preferably connected to mounting assembly 102) and the other end connected to a connection point 154 on blade 26 under tension (i.e., without any appreciable slack) (see FIG. 1).

Figure 9:
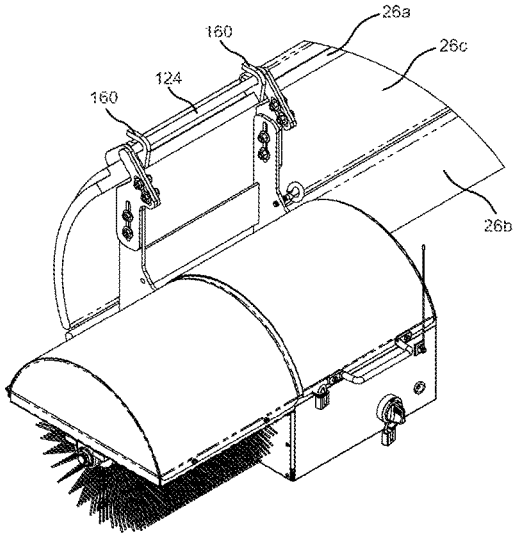
FIG. 9 is a right front quarter perspective view of an alternate embodiment of a mounting assembly of the subject sweeper apparatus mounted to a blade.
Figure 10:
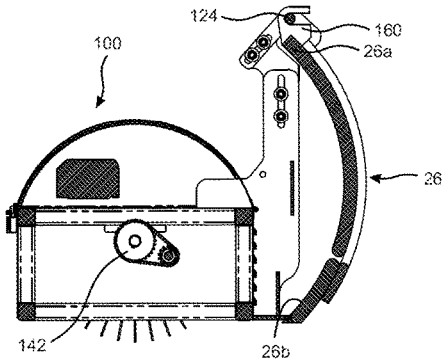
FIG. 10 is left side sectional view of the sweeper apparatus taken along line A-A of FIG. 9.
Figure 11:
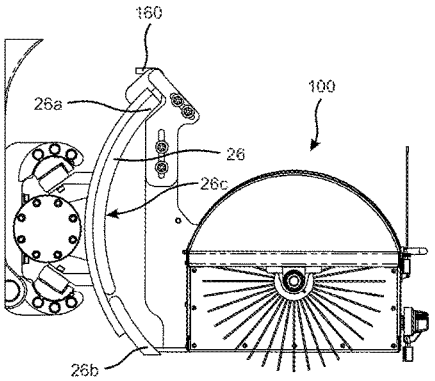
FIG. 11 is a right side elevation view of the sweeper apparatus of FIG. 9.

In other embodiments, a more positive attachment of sweeper apparatus 100 generally, and its mounting assembly 102 in particular, to blade 26 may be achieved by attaching at least one, and preferably two, generally C-shaped hooks 160 to top edge 26*a* of blade 26 using bolts or welding as illustrated in FIGS. 9-11. Hooks are mounted to top edge 26*a* a distance from one another slightly less than the distance between vertical supports 110*a,* 110*b* of mounting assembly 102. Thusly mounted, the operator causes blade 26 to be positioned immediately behind the mounting assembly 102 of the sweeper apparatus 100 with hooks 160 being positioned between channels 122*a,b.* Next, the top edge 26*a* of blade 26 is tilted forward a sufficient degree (more so than for the above-described embodiment) to permit hooks 160 to pass underneath crossbar 124 while simultaneously aligning top edge 26*a* of blade 26 with channels 122*a,b.* Motor grader 10 is then slowly idled forward until hooks 160 pass under crossbar 124 and top edge 26*a* is inserted into channels 122*a,b.* Blade 26 is then tilted back to normal (vertical) position while simultaneously lifting the blade vertically causing hooks 160 to engage the crossbar 124 with top edge 26*a* firmly seated within channels 122*a,b.* Here also, the bottom of mounting assembly 102 will come into abutting contact with the cutting edge 26*b* of the blade. As may be observed upon reference to FIG. 10 in particular, the hooks 160 prevent vertical displacement of the sweeper apparatus 100. Moreover, because hooks 160 are fastened to the blade they prevent any lateral movement of sweeper apparatus 100 along top edge 26*a* thus eliminating the need for tether 150. In both of the above-described embodiments, dismounting is accomplished by reversing the mounting steps.

In operation, once the sweeper apparatus 100 is mounted to one side of the blade 26 and the motor 128 is activated, the bristles 136 of the rotating drum brush 132 will remove any ground material or other debris from the curb gutter as the motor grader travels along its length, with its operator selectively adjusting the degree of contact of the drum brush bristles with the curb surface by precisely adjusting the height of the blade relative to the surface to be cleaned. Note that the direction of rotation of sweeper shaft 130 should be such that debris is propelled forward of the sweeper apparatus 100 in the direction of the motor grader's travel.

To keep sweeper motor 128 and other components within carrier box portion 104*a* of carrier frame 104 clean and to protect them from flying debris and dust, carrier box portion 104*a* is preferably outfitted with an outer cabinet comprised of floor panel (not shown), side panels 170, and a curved lid 172 typically hingedly mounted to the frame and having a handle 174 for opening the lid. A pair of curved end walls 176 mounted at opposite ends of the lid 172 complete the enclosure. One or more side panels 170 may be adapted with vents as shown to permit exhaust to escape from the cabinet and prevent the buildup of heat. Sweeper brush assembly 106 is also preferably covered with a removable safety lid 178 and end wall 176 each of which are mounted to carrier shelf portion 104*b* above drum brush 132. In some embodiments, safety lid 178 is removably or pivotally mounted to facilitate removal of drum brush 132 for maintenance or replacement.

In some embodiments, sweeper apparatus 100 may be equipped with a cabinet or frame mounted electric start switch 180 in electrical communication with a battery (not shown) and sweeper motor 108 for starting the latter. The switch also serves as an emergency stop switch.

In some embodiments, sweeper apparatus 100 may be controlled by a remote brush control unit 182 in operable communication with sweeper motor 108 via hard wiring or via a wireless receiver 184 as is known in the art. The control unit 182 is ideally mounted inside of cab 28.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

The invention claimed is:

1. A sweeping apparatus for releasable engagement with a blade of a blade-carrying machine, the blade being arcuate in cross-section and having a top edge, a bottom edge, a left end portion, a right end portion, and a front face, the sweeping apparatus comprising:

a. a height and depth adjustable mounting assembly, comprising;

i. a first vertical support and a second vertical support connected to one another by at least one cross brace, each said first vertical support and said second vertical support having a top portion;

i. a first vertical extension member slidably and adjustably mounted to said top portion of said first vertical support, a second vertical extension member slidably and adjustably mounted to said top portion of said second vertical support, said first vertical extension member including a first forward canted arm, said second vertical extension member including a second forward canted arm, said first forward canted arm terminating in a first rearward canted arm extending perpendicular to said first forward canted arm, said second forward canted arm terminating in a second rearward canted arm extending perpendicular to said second forward canted arm; and i. a first L-shaped extension bracket slidably and adjustably mounted to said first rearward canted arm to form a first U-shaped channel into which the top edge of the blade is inserted when mounting said sweeping apparatus to the blade, and a second L-shaped extension bracket slidably and adjustably mounted to said second rearward canted arm to form a second U-shaped channel into which the top edge of the blade is inserted when mounting said sweeping apparatus to the blade;

b. a carrier frame fixedly connected to said mounting assembly;

c. a sweeper brush assembly mounted to said carrier frame; said sweeper brush assembly including;

i. one of a sweeper shaft or drum rotatable about a longitudinal axis substantially parallel with the ground; and ii. a cylindrical brush head comprising a brush hub mounted to said sweeper shaft or said drum for rotation therewith, said brush hub having a plurality of bristles, and d. a sweeper motor mounted to said carrier frame and having a crankshaft coupled to said sweeper shaft to cause rotation of said sweeper shaft when said motor is energized;

whereby mounting of said sweeping apparatus across the front face of selectively either the left end portion or right end portion of the blade is accomplished by tilting the top edge of the blade forward, driving the blade-carrying machine forward until the top edge of the blade is inserted into said mounting assembly, tilting the top edge of the blade rearward and simultaneously lifting the blade vertically until the bottom of said mounting assembly comes into abutting contact with the bottom edge of the blade; and whereby, the depth of each said U-shaped channel is adjustable to accommodate blades of varying thickness by sliding said first and said second extension brackets proximally or distally relative to the rearward canted arms from which they depend.

2. The sweeping apparatus of claim 1, wherein said first extension bracket includes a first elbow and said second extension bracket includes a second elbow, said first elbow and said second elbow being connected by a crossbar with which one or more mounting hooks attached to the top edge of the blade may be engaged.

3. The sweeping apparatus of claim 2, wherein said motor is an electric motor and said crankshaft is substituted with a rotor.

4. The sweeping apparatus of claim 2, wherein said crankshaft is coupled to said sweeper shaft via a chain drive assembly.

5. The sweeping apparatus of claim 4, wherein said chain drive assembly includes gear reduction means.

6. The sweeping apparatus of claim 5, wherein said sweeper motor is a hydraulic motor.

7. The sweeping apparatus of claim 5, wherein said sweeper motor is a pneumatic motor.

8. The sweeping apparatus of claim 4, wherein said sweeper motor is a hydraulic motor.

9. The sweeping apparatus of claim 4, wherein said sweeper motor is a pneumatic motor.

10. The sweeping apparatus of claim 2, wherein said sweeper motor is a hydraulic motor.

11. The sweeping apparatus of claim 2, wherein said sweeper motor is a pneumatic motor.

12. The sweeping apparatus of claim 1, wherein said motor is an electric motor and said crankshaft is substituted with a rotor.

13. The sweeping apparatus of claim 1, wherein said crankshaft is coupled to said sweeper shaft via a chain drive assembly.

14. The sweeping apparatus of claim 13, wherein said chain drive assembly includes gear reduction means.

15. The sweeping apparatus of claim 14, wherein said sweeper motor is a hydraulic motor.

16. The sweeping apparatus of claim 14, wherein said sweeper motor is a pneumatic motor.

17. The sweeping apparatus of claim 13, wherein said sweeper motor is a hydraulic motor.

18. The sweeping apparatus of claim 13, wherein said sweeper motor is a pneumatic motor.

19. The sweeping apparatus of claim 1, wherein said sweeper motor is a hydraulic motor.

20. The sweeping apparatus of claim 1, wherein said sweeper motor is a pneumatic motor.

* * * * *